US011535410B2

(12) United States Patent
Calamosca et al.

(10) Patent No.: US 11,535,410 B2
(45) Date of Patent: Dec. 27, 2022

(54) DEVICE FOR FEEDING FILM FOR PACKAGING PRODUCTS

(71) Applicant: T.M.C. S.P.A., Castel Guelfo (IT)

(72) Inventors: Andrea Calamosca, Imola (IT); William Rossi, San Giorgio di Piano (IT)

(73) Assignee: T.M.C. S.P.A., Castel Guelfo (IT)

( * ) Notice: Subject to any disclaimer, the term of this patent is extended or adjusted under 35 U.S.C. 154(b) by 0 days.

(21) Appl. No.: 17/618,312

(22) PCT Filed: Jul. 13, 2020

(86) PCT No.: PCT/IB2020/056566
§ 371 (c)(1),
(2) Date: Dec. 10, 2021

(87) PCT Pub. No.: WO2021/014269
PCT Pub. Date: Jan. 28, 2021

(65) Prior Publication Data

US 2022/0204200 A1 Jun. 30, 2022

(30) Foreign Application Priority Data

Jul. 19, 2019 (IT) ..... 102019000012426

(51) Int. Cl.

| | |
|---|---|
| ***B65B 11/08*** | (2006.01) |
| ***B65B 11/00*** | (2006.01) |
| ***B65B 41/16*** | (2006.01) |
| ***B65B 57/06*** | (2006.01) |
| ***B65B 59/00*** | (2006.01) |
| ***B65B 59/02*** | (2006.01) |
| ***B65B 61/12*** | (2006.01) |
| ***B65H 35/04*** | (2006.01) |

(52) U.S. Cl.
CPC ..... *B65B 11/08* (2013.01); *B65B 11/004* (2013.01); *B65B 41/16* (2013.01); *B65B 57/06* (2013.01); *B65B 59/005* (2013.01); *B65B 59/02* (2013.01); *B65B 61/12* (2013.01); *B65H 35/04* (2013.01); *B65H 2301/5152* (2013.01); *B65H 2404/261* (2013.01); *B65H 2408/2171* (2013.01); *B65H 2801/81* (2013.01)

(58) Field of Classification Search
USPC ..... 53/461
See application file for complete search history.

(56) References Cited

U.S. PATENT DOCUMENTS

| | | | | |
|---|---|---|---|---|
| 5,179,815 | A | 1/1993 | Cahill et al. | |
| 6,523,595 | B1 | 2/2003 | Milner et al. | |
| 2002/0073649 | A1* | 6/2002 | Gamberini | B65B 61/12 53/376.2 |

FOREIGN PATENT DOCUMENTS

| | | | | |
|---|---|---|---|---|
| EP | 0312877 | A2 | 4/1989 | |
| WO | WO-2005032946 | A1 * | 4/2005 | B65B 61/12 |
| WO | 2008048422 | A2 | 4/2008 | |
| WO | 2009156193 | A1 | 12/2009 | |

OTHER PUBLICATIONS

International Search Report and Written Opinion dated Oct. 22, 2020 from counterpart International Patent Application No. PCT/IB2020/056566.

* cited by examiner

*Primary Examiner* — Chinyere J Rushing-Tucker
(74) *Attorney, Agent, or Firm* — Shuttleworth & Ingersoll, PLC; Timothy J. Klima

(57) ABSTRACT

Described is an apparatus for packaging tissue products and a relative packaging method.

13 Claims, 6 Drawing Sheets

DEVICE FOR FEEDING FILM FOR PACKAGING PRODUCTS

This application is the National Phase of International Application PCT/EP2020/056566 filed Jul. 13, 2020 which designated the U.S.

This application claims priority to Italian Patent Application No. 102019000012426 filed Jul. 19, 2019, which application is incorporated by reference herein.

TECHNICAL FIELD

This invention relates to an apparatus for packaging tissue products and a relative packaging method.

BACKGROUND ART

Tissue products are products for sanitary and/or medical purposes, such as, for example, kitchen rolls, toilet paper, napkins, tissues, medical sheets, industrial rolls.

These products are packaged by packaging the product, or group of products, in a piece of packaging material, which may be, for example, a plastic film.

The term "article" is used to mean a product or a group of products, for example of tissue type.

The apparatuses for packaging articles are configured to perform the packaging method by means of a step of drawing the film along an operating path. The method comprises, for each article and during the step for drawing the film, a step of separating the individual respective length from the rest of the film. The method comprises, after the drawing step, a step of wrapping the respective piece around the article. The step of separating the piece is performed by tearing the piece, after having obtained a certain weakness on the film which can facilitate the tearing operation. The separating step is performed using the same drawing system which causes the film to be pulled along the working path.

The wrapping step is performed using a wrapping system which moves the article with respect to the piece, causing the piece to be intercepted by the article and thus causing it to be wrapped in the piece. Thus, the wrapping step occurs by suitably positioning the piece relative to the wrapping system, and in particular with respect to an axis which is transversal to the operating path of the film, the movement of the article relative to the piece occurring along the axis. This axis is known in the jargon of the trade as the elevation axis, as the article is usually lifted so that it intercepts the piece.

The dimension of the piece, along the operating path, depends on and/or is correlated with at least a first dimension of the article.

For example, the dimension of the piece should be equal to a first dimension of the article, for example a horizontal length, added at least to a second dimension of the article, for example a vertical height.

As the first dimension of the article varies, the dimension of the piece along the operating path must also vary.

The drawing step is performed by means of at least two drawing units which act by applying respective drawing forces on a first sector and on a second sector of the operating path. The tearing step is performed by differentiating the respective drawing forces, in such a way that the positioning along the operating path of the piece is correlated with the positioning along the operating path of a third intermediate sector of the operating path, the third intermediate sector being interposed between the first sector and second sector.

The distance along the operating path at which there is the front end of the film, and therefore the torn piece, at the moment of tearing, therefore varies as a function of the dimension of the piece.

The piece, regardless of its size, must in any case be suitably positioned with respect to the above-mentioned axis, when the wrapping system operates.

For this reason, after the tearing step, the piece must be pulled further by a distance which is a function of the dimension of the piece, in such a way that it is correctly positioned.

The inertial effects due to the tearing step create a sail effect which results in an undulation of the piece. The undulation adversely affects the correct positioning of the piece relative to the above-mentioned axis, and therefore the accuracy of the wrapping step.

As the dimension of the piece along the operating path decreases, the distance which must be covered after tearing increases, and therefore the accuracy of the wrapping step is affected even more.

Moreover, as the thickness of the film decreases, the difficulty of checking the movement of the piece during drawing after the tearing increases, especially during the final braking phase. This difficulty is increased by the above-mentioned inertial effects due to the tearing step.

DISCLOSURE OF THE INVENTION

A packaging method according to this description and/or according to one or more of the accompanying method claims allows a plurality of successive articles to be automatically packaged by means of a plastic film, maintaining an excellent packaging accuracy with variations of one or more dimensions of the articles, as well as allowing simpler control of the components affected by the drawing of the plastic film.

An apparatus according to this invention and/or according to one or more of the accompanying apparatus claims is configured to perform a method according to this description and/or according to one or more of the accompanying method claims.

The features of a method and an apparatus according to the invention will become clearer from the following detailed description of respective possible example embodiments of the method and apparatus.

BRIEF DESCRIPTION OF DRAWINGS

The following detailed description refers to the accompanying drawings, in which.

DETAILED DESCRIPTION OF PREFERRED EMBODIMENTS OF THE INVENTION

The drawings refer to a possible example embodiment of an apparatus according to the invention. The term "apparatus" is used to mean the possible embodiment of the apparatus by way of example.

The drawings refer to a possible example embodiment of a method according to the invention. The term "method" is used to mean the possible embodiment of the method.

The apparatus is configured to perform the method.

Figure 1:
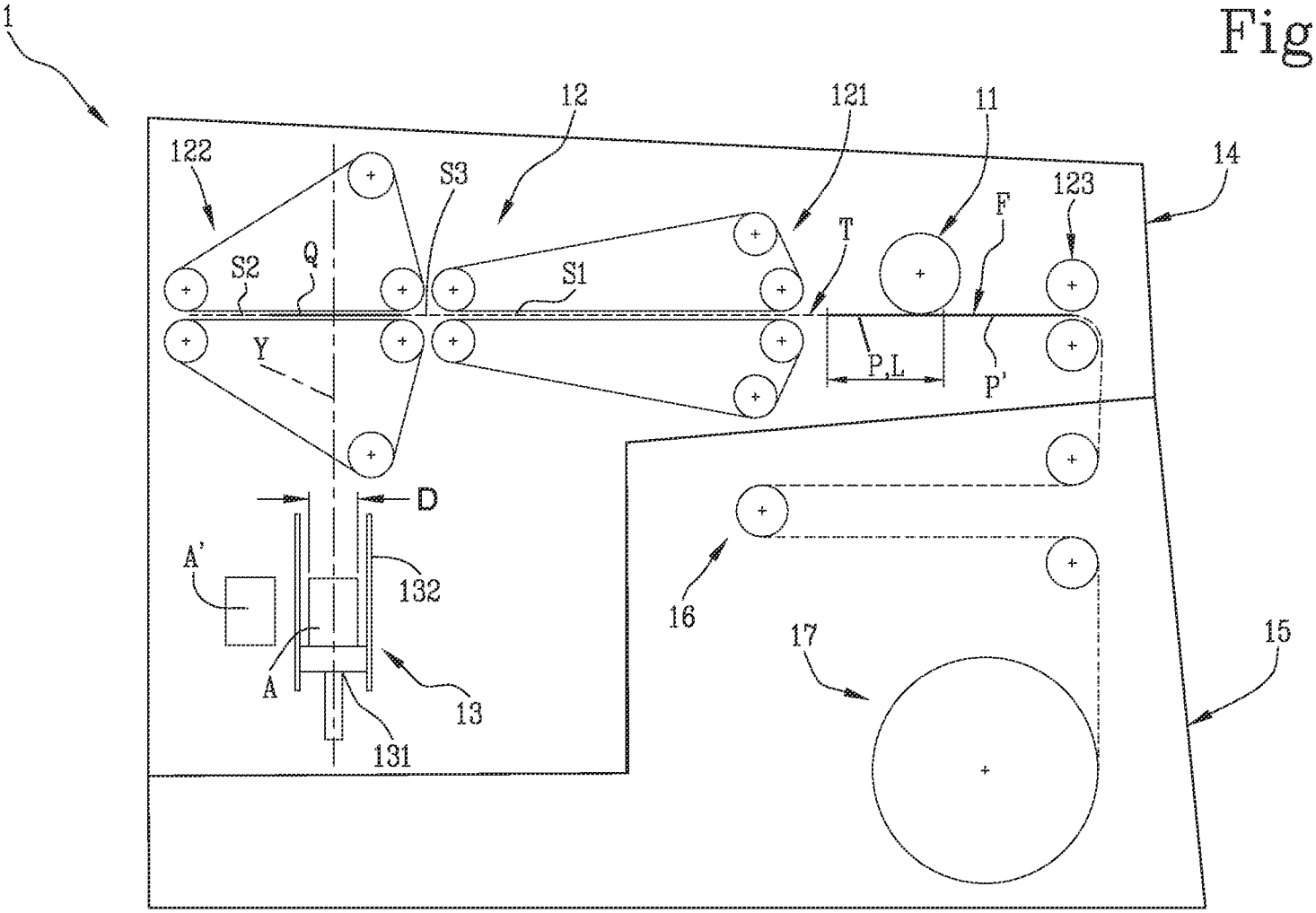
FIG. 1 is a schematic side view of a first variant embodiment of a possible example of an apparatus according to the invention.

The apparatus 1 is for the automatic packaging of at least one article in or by means of a film. The film is a plastic film F. FIG. 1 also schematically shows a further article A', in addition to the article A. It is assumed that both the article A and the further article A' have a first dimension equal to D.

The at least one article may be considered by way of example to correspond to the article labelled A.

The method is a method for automatic packaging using the plastic film F of at least one article A or of a plurality of articles. The plurality of articles can be considered, for example, as comprising the article A and the further article A'.

Each article is to be considered as comprising, for example, at least one tissue product or a group of tissue products.

The apparatus comprises an automatic control system. The control system comprises at least one processing and control unit.

The method comprises performing an operating sequence, at least for the article A.

The apparatus 1 comprises a weakening system 11. The weakening system 11 is configured to perform a step of weakening a part P of the film F, in such a way as to obtain a weakness on said part P. The weakening could be, for example, a perforation. The weakening system could comprise, for example, a knife or a blade or any element designed to make a weakness in the film F.

The operating sequence comprises the weakening step.

The control system is configured to control the weakening system so that the weakening system performs the weakening step.

The apparatus 1 comprises a drawing system 12. The drawing system 12 is configured to perform a step of drawing at least said part P along an operating path T. The path T is represented in FIGS. 1, 3, 4, 5 and 6 with a dashed line.

Figure 2:
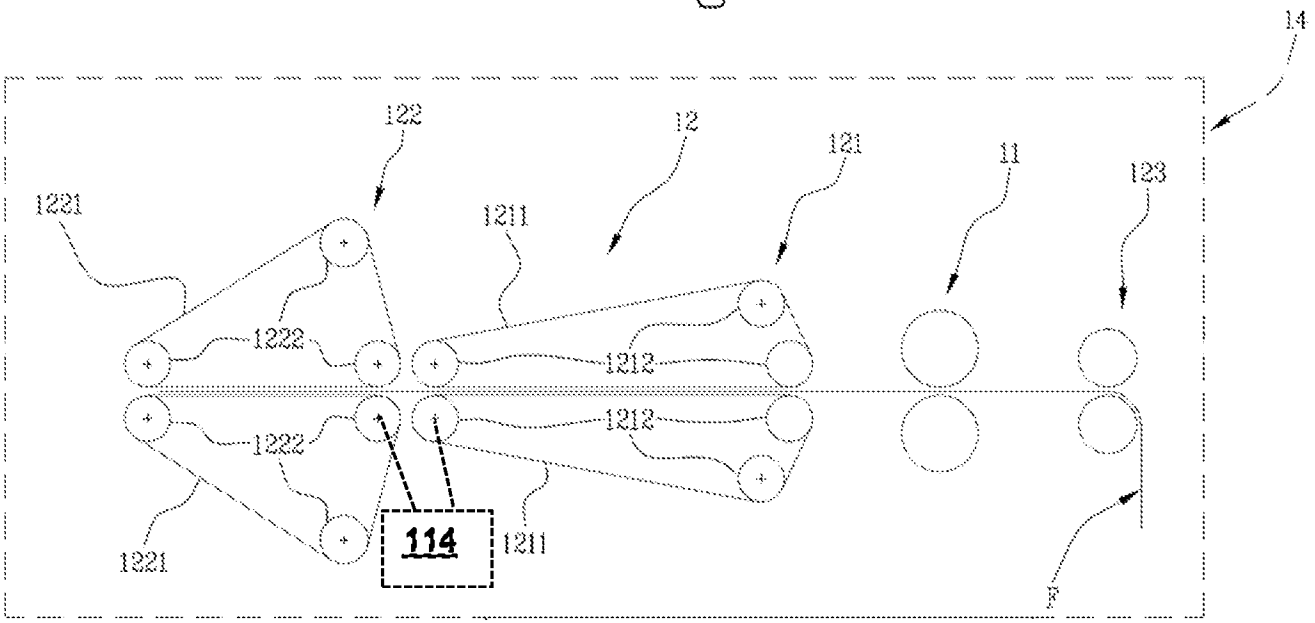
FIG. 2 is a schematic side view of some components of the apparatus of FIG. 1.

FIG. 1 shows for clarity only a section of the film F which comprises the part P and a further part P' of the film F. FIG. 2 shows a larger stretch of the film F compared to FIG. 1. FIG. 1 shows only the parts P and P' since the film F would otherwise superpose the operating path T.

The operating sequence comprises the drawing step. The control system is configured to control the drawing system 12 so that the drawing system performs the drawing step.

The weakening system 11 is configured to obtain the weakness in such a way that it extends along a part of or along the entire extension of the film F in a transversal direction or at a right angle to the drawing direction along the operating path T or transversal or at right angles to the operating path T.

The drawing system 12 is configured for performing, during said drawing step, a step of separating said part P from the remaining part of the film F, in such a way that said part P, once separated, corresponds to a piece Q of the film F. For this reason, the step of puling the part P corresponds, before the separating step, to the drawing of the entire film F which comprises the part P and, after the separating step, the drawing of the piece Q.

In any case, even before the separating step, the drawing step, given that it corresponds to the drawing of the film F along the operating path T, can be considered to be a step of drawing at least the part P of the film F along a first part of the operating path T. After the separating step, the drawing step corresponds to the drawing of the part P separated, which is the piece Q, along a second part of the operating path T.

The operating sequence comprises the separating step. The separating step is performed after the weakening step.

The drawing system 12, in order to perform said drawing step, is configured to apply on said film F at least a first drawing force along a first sector S1 of said path T and a second drawing force along a second sector S2 of said path T. The first sector S1 and second sector S2 define between them a third intermediate sector S3, which is interposed, along the path T, between said first sector S1 and second sector S2. The first sector S1, second sector S2 and third sector S3 are positioned, along said path T, downstream of the weakening system 11. These sectors are indicated in FIGS. 1, 3, 4, 5 and 6.

The drawing step is performed by applying on said film at least a first drawing force along the first sector S1 and a second drawing force along the second sector S2.

The drawing system 12 comprises, for applying said first force, a first drawing unit 121. The first drawing unit 121 is operatively positioned along said first sector S1. The drawing system 12 comprises, for applying said second force, a second drawing unit 122. The second drawing unit 122 is operatively positioned along said second sector S2. The first drawing unit 121 and the second drawing unit 122 are operatively positioned, according to the drawing direction along said path T, downstream of said weakening system 11. The drawing system 12 is configured so that the first drawing unit 121, for applying the first force, contacts the film F along the first sector S1. The drawing system 12 is configured so that the second drawing unit 122, for applying the second force, contacts the film F along the second sector S2.

The drawing system 12 comprises a third drawing unit 123. The third drawing unit 123 is operatively positioned, according to the drawing direction along the path T, upstream of said weakening system 11. The third drawing unit 123 could comprise, for example, a pair of unwinding rollers located on mutually opposite sides of the operational path T.

The apparatus 1 could also comprise a feed unit 17 for feeding the film F. The feed unit 17 could be, for example, a reel unwinder roller.

The apparatus 1 could also comprise a group of dandy rolls 16.

The feed unit 17 is located upstream of the group of dandy rolls 16, according to the drawing direction along the operating path T.

The group of dandy rolls 16 is situated upstream of the third drawing unit 123, according to the drawing direction along the operating path T.

The drawing system 12 is configured so that each of said first drawing unit 121 and second drawing unit 122 can apply the respective force by means of a respective drawing movement tangential to the operating path T and/or to the film F, so that the respective force is proportional to the speed of the respective drawing movement.

The positioning of each drawing unit 121 or 122 on the respective sector S1 or S2 of the operating path T is visible, for example, in FIGS. 1, 3, 4, 5 and 6.

Each drawing unit 121 or 122 is configured to apply the respective drawing force by contacting the film F along the respective sector S1 or S2 of the operating path T.

The drawing system 12 is configured to perform said separating step, differentiating from each other said drawing forces. For example, the separating step could be performed by differentiating from each other these drawing forces while the weakness is positioned in the third intermediate sector S3.

The separating step is performed by differentiating from each other said drawing forces, for example while the weakness is positioned in said third intermediate sector S3.

The control system is configured to control the drawing system 12 so that the drawing system performs the separating step, differentiating between them the respective forces applied by the drawing units 121 and 122.

The apparatus comprises a wrapping system 13. The wrapping system 13 is configured to cause and/or perform a step of wrapping said article A in said piece Q.

The operating sequence comprises the wrapping step.

The control system is configured to control the wrapping system 13 so that the wrapping system 13 performs the wrapping step.

The wrapping system 13 is configured to perform said wrapping step by moving the article A along an axis Y transversal to said path T, in such a way that said article A intercepts transversely the piece Q along said axis Y.

The wrapping step is performed by moving said article A along an axis Y transversal to said operating path T, in such a way that said article A intercepts transversely the piece Q along said axis Y.

The wrapping system 13 comprises, for example, a channel 132 and a supporting element 131. The wrapping system 13 is configured so that the translation of the supporting element 131 along the channel 132, whilst the supporting element 131 supports the article A, corresponds to a translation of the article A along the axis Y, in such a way that the article A can be guided along the axis Y towards the piece Q. The wrapping system 13 is configured so that the article A intercepts the piece Q, for the purpose of wrapping the article A along the axis Y.

The drawing 12, for the purposes of separating the part P from the remaining part of the film F during the drawing step, and therefore for the purposes of obtaining the piece Q, is configured to differentiate between them said the drawing forces, differentiating between them the respective drawing speed of the drawing movements of the respective drawing units 121 and 122.

The first drawing unit 121 is closer to the weakening system 11, with respect to the second drawing unit 122. The second drawing unit 122 is closer to the wrapping system 13, with respect to the first drawing unit 121.

The drawing system 12 could be configured to differentiate the speeds of the respective drawing movements, so that the speed of the drawing movement of the second drawing unit 122 is greater than the speed of the drawing movement of the first drawing unit 121.

For this reason, the drawing system 12 is configured to perform the step of separating the part P of the film F from the remaining part of the film F, in such a way as to form the piece Q which will wrap the article A, by means of a predetermined time trend of the speed ratio between the speed of the drawing movement of the second drawing unit 122 and the speed of the drawing movement of the first drawing unit 121, whilst the film F is pulled by both the first drawing unit 121 and the second drawing unit 122.

The step of separating the part P of the film F from the remaining part of the film F, with which is formed the piece Q which will wrap the article A, is performed by means of a predetermined time trend of the speed ratio between the speed of the drawing movement of the second drawing unit 122 and the speed of the drawing movement of the first drawing unit 121, whilst the film F is pulled by both the first drawing unit 121 and the second drawing unit 122.

The drawing system 12 is configured to perform the separating step acting on the time trend in such a way that the speed ratio is, for at least a time interval, greater than one and reaches at least a maximum peak during the time interval.

The separating step is therefore performed by acting on the time trend in such a way that the speed ratio is, for at least a time interval, greater than one and reaches at least a maximum peak during the time interval.

The weakening system 11 is configured to repeat, for each article of a plurality of articles, said weakening step. The weakening system 11 is configured to repeat the weakening step in such a way as to obtain a plurality of weaknesses on said film F with a weakness spacing along the path T. The control system is configured to control the weakening system 11 so that the weakening system 11 repeats the weakening step for each article of the plurality. The control system is therefore configured to control the weakening system 11 so that the weakening system 11 obtains the plurality of weaknesses with the weakening step.

The drawing system 12 is configured to repeat, for each article of the plurality, said drawing and separating steps.

The control system is configured to control the drawing system 12 so that the drawing system 12 repeats the drawing and separation steps for each article of the plurality.

The wrapping system 13 is configured to repeat, for each article of the plurality, said wrapping step.

The control system is configured to control the wrapping system 13 so that the wrapping system 13 repeats the wrapping step for each article of the plurality.

The method therefore comprises repeating the operating sequence, which comprises the above-mentioned weakening, drawing and separating steps, and wrapping, for each article of the plurality of articles. The respective weakening steps are performed in such a way as to obtain a plurality of weaknesses on said film F with the weakness spacing along the path T.

Therefore, during each repetition of the operating sequence a respective piece is obtained, for example the one labelled Q in FIG. 1, which will wrap a respective article, for example, that labelled A in FIG. 1. During each repetition of the operating sequence, the respective piece Q is obtained by forming a respective weakness on a respective part of the film F, for example the one labelled P in FIG. 1, and separating the part P from the remaining part of the film F. During each repetition of the operating sequence, the separation of the respective part P is obtained by differentiating the speeds of the respective drawing movements, along the operating path T, of the first drawing unit 121 and of the second puling unit 122, whilst the drawing units 121 and 122 are simultaneously drawing the film F by means of the respective drawing movements. This separation is also obtained using the positioning or passage between the drawing units 121 and 122, and, therefore, through the intermediate sector S3, of the respective weakening of the respective part P.

The desired extension of the piece Q along the path T means an extension of the piece Q along the operating path T which an operator wishes to obtain during the performance of the method.

The desired extension of the piece Q is also to be considered for simplicity equal to the actual extension of the piece Q along the path T. Hereafter, the extension of the piece Q means the desired extension of the piece Q along the operating path T or the actual extension of the piece Q along the operating path T, which, for simplicity, are assumed to be equal to each other.

Considering a single article of the plurality, for example the article A, since the separation of the respective part P from the remaining part of the film F is carried out by tearing, using the weakness obtained on the respective part, the above-mentioned weakening step can be considered as correlated with or equal to the extension of the piece Q. For the sake of simplicity, the weakening spacing may be assumed to be equal to the length of the piece Q. In FIG. 1 the extension of the piece Q is labelled L with reference to the part P which will then define the piece Q but where the part P is still joined to the rest of the film F. For this reason, the extension of the piece Q can be considered to correspond to the extension L of part P which, once it is separated, becomes the piece Q.

The extension L of the piece Q can be considered to e correlated to at least a first dimension of each article of the plurality of articles.

The first dimension could be that labelled D in FIG. 1. The first dimension D could in turn be considered as correlated with the size of each article of the plurality of articles to be packaged, which are assumed ideally to match each other.

The first dimension D could be considered as the extension of the article A along the operating path, considering the article A at the moment it intercepts the piece Q.

The correlation between extension L of the piece Q and first dimension of the article A is for the purposes of a correct packaging of the article A.

For example, if the first dimension D were a length of the article A, the extension of the piece Q could be equal to the length of the article plus a height of the article, so that the piece Q can also cover the outer side walls of the article A, plus an additional stretch, known as excess material, which is aimed at having an adequate overlapping of the plastic material so that once the film is closed on itself, for example sealed, the product cannot be reached from the outside.

Hereafter, the term "input value" means a value correlated with the weakness spacing, and therefore correlated with the extension L of the piece Q, and, therefore, correlated with the first dimension D of the article, and therefore correlated with the size of the article.

Hereafter, the inlet value is to be considered a function of the extension of the piece Q, in such a way as to increase with the increase in the extension of the piece Q. Hereafter, the extension of the piece Q, in turn, is to be considered a function of the first dimension D of the article A, in such a way as to increase with the increase of the first dimension D of the article A.

The apparatus 1 could be configured so that an operator can perform a preliminary step of setting up the input value in the apparatus. For this purpose, the apparatus 1 could comprise an interface configured to allow the operator to enter and/or set the input value.

The method could comprise this preliminary setting up step, during which the operator sets up or enters the input value, for example by means of the interface.

The setting of the input value means an action starting from which the apparatus derives the input value, regardless of the parameter or the quantity actually entered by the operator, who could have the possibility of selecting from one or more possibilities, even, if necessary, without having to enter the input value.

The setting up step is preliminary, in that it is performed before all the repetitions of the operating sequence, since the input value is used automatically at least by the weakening system 11 for performing each repetition of the weakening step, in such a way that the weakening spacing is such as to obtain the extension of the piece Q corresponding to the set input value.

The separation step produces negative effects on the correctness of the positioning of the piece Q relative to the axis Y during the wrapping step, and on the precision in the control of the final part of the drawing step by the control system.

In effect, these negative effects increase with the increase in the above-mentioned peak between the speed of the drawing movement of the second unit 122 and the speed of the drawing movement of the first unit 121, which practically defines an acceleration peak of the second unit 122 relative to the first unit 121.

The apparatus 1 is configured to perform a preliminary step of adjusting the distance d along the path T between said intermediate sector S3 and said axis Y. This distance along the path T between said intermediate sector S3 and said axis Y will be referred to hereafter only as "distance".

The concept of performing the adjustment step means including a first alternative such that the apparatus 1 is configured to allow the operator to perform the adjustment step by acting on the apparatus 1, and a second alternative such that the apparatus is configured to perform the adjustment step automatically based on the input value.

According to this first alternative, the operator could perform the adjustment step as a function of the input value, even if in that case the input value is not set in the apparatus.

The fact that the operator performs the adjustment step as a function of the input value means that the operator performs the adjustment step as a function of the extension of the piece Q, and therefore as a function of the first dimension D of the article A.

In general, the extension of the piece Q, during the setting up step and/or during the adjustment step, still needs to be considered as "desired", since the operating sequences have not yet started, whilst the first dimension D, during the setting up step and/or during the adjustment step, should already be an effective data item.

According to the second alternative, the apparatus is configured to perform the adjusting step automatically as a function of the set input value. In that case, it is the apparatus which automatically performs the adjustment step, and the operator sets up in the apparatus the input value as a function of the extension of the piece Q, and therefore as a function of the first dimension D of the article A. For this reason, in this case, it is the apparatus which performs the adjustment step of the distance d automatically as a function of the extension of the piece Q along the operating path, and therefore as a function of the first dimension D of the article A, and therefore as a function of the size of the article A.

The adjustment of the distance d as a function of the input value makes it possible to reduce the above-mentioned peak acceleration, so as to reduce the negative effects, thus avoiding the loss of productivity which would be correlated with this reduction of the peak acceleration.

In effect, the reduction in the distance d makes it possible to compensate in terms of productivity for the reduction of the peak acceleration. In this regard, it should be noted that, after the separating step, the piece Q must travel along a final section of the path T. Starting from the premise that the piece Q must be positioned correctly relative to the axis Y during the wrapping step, the length of the final section increases with the increase in distance d. Consequently, a reduction in the distance d produces an increase in productivity which would be lost due to the reduction of the peak acceleration.

The control system is configured, in accordance with the first alternative, for allowing the operator to perform the adjustment step, or, according to the second alternative, to automatically perform the adjustment step.

The method could comprise the preliminary adjustment step.

The adjustment step is preliminary in that the first of the repetitions of the operating sequence is performed, in such a way that the distance d is constant for all the other articles of the plurality of articles, articles being assumed to be equal to each other.

According to the second alternative, the apparatus 1 is configured to automatically perform the adjustment step by means of a mathematical function according to which the distance d increases with the increase of the input value and/or it reduces with the reduction in the input value.

Since the input value is assumed to increase with the increase in the extension of the piece Q, the mathematical function ensures that the distance d increases with increase in the dimension of the piece Q and decreases with the decrease in the dimension of the piece Q, and is therefore such that it increases with the increase in the first dimension D of the article A and decreases with the decrease of the first dimension D of the article A.

According to the second alternative, the control system is configured to automatically perform the adjustment step on the basis of the mathematical function or by means of the mathematical function.

In accordance with the second alternative, the adjustment step could therefore be performed automatically by means of the mathematical function.

The mathematical function makes it possible to ensure that the adjustment of the distance as a function of the input value is automatically performed in accordance with the dimension of the piece Q, as the distance d must allow a sufficient space to be formed to stop the separate piece Q, for the entire range of extension of the piece Q in which the apparatus 1 can operate or for which the method is intended to be performed. The aim of the invention is therefore achieved to provide an apparatus or a method for the automatic packaging of tissue type articles using a film, which performs the step of wrapping each article in a piece of film previously torn, by means of which it is possible to maintain an excellent productivity of the method or apparatus reducing the negative effects of the tearing step on the wrapping step, with variations in the extension of the articles which are to be packaged using the apparatus or method.

Each of said drawing units 121 and 122 comprises a respective pair of belts and a respective tensioning unit for tensioning and moving the belts of the respective pair along respective tensioning paths. The pair of belts of the first drawing unit 121 is labelled 1211 in FIG. 2. The pair of belts of the second drawing unit is labelled 1221 in FIG. 2. The tensioning unit of the first drawing unit 121 is labelled 1212 in FIG. 2.

The tensioning unit of the second drawing unit 122 is labelled 1222 in FIG. 2.

For each drawing unit 121 or 122, the variation of the geometrical configuration of the tensioning unit 1212 or 1222 corresponds to a variation of the respective tensioning paths of the belts of the respective pair 1211 or 1221.

For each drawing unit 121 or 122, the belts of the respective pair 1211 or 1221 are situated on opposite sides of said operating path T, in such a way that the drawing movement of each drawing unit 121 or 122 is a movement of the respective belts designed to progressively draw the film tangentially to the belts and between the belts.

The apparatus comprises a structure 14 which supports said weakening system 11 and drawing system 12. The apparatus 1 comprises an adjustment system 114.

The apparatus 1 is configured so that the adjustment step is performed by means of an adjustment movement caused by the adjustment system 114.

The adjustment system is configured to cause an adjustment movement by means of which the above-mentioned adjustment step is performed.

In accordance with the above-mentioned second alternative, the control system is configured to perform the adjustment step automatically by acting on the adjustment system. In accordance with the above-mentioned first alternative, the apparatus is configured to allow the operator to perform the adjustment step acting on the adjustment system.

The structure 14 is represented very schematically in FIGS. 1, 3, 4, 5 and 6.

The apparatus 1 comprises a frame 15 which supports the structure 14.

The frame 15 is represented very schematically in FIGS. 1, 3, 4, 5, and 6.

Figure 3:
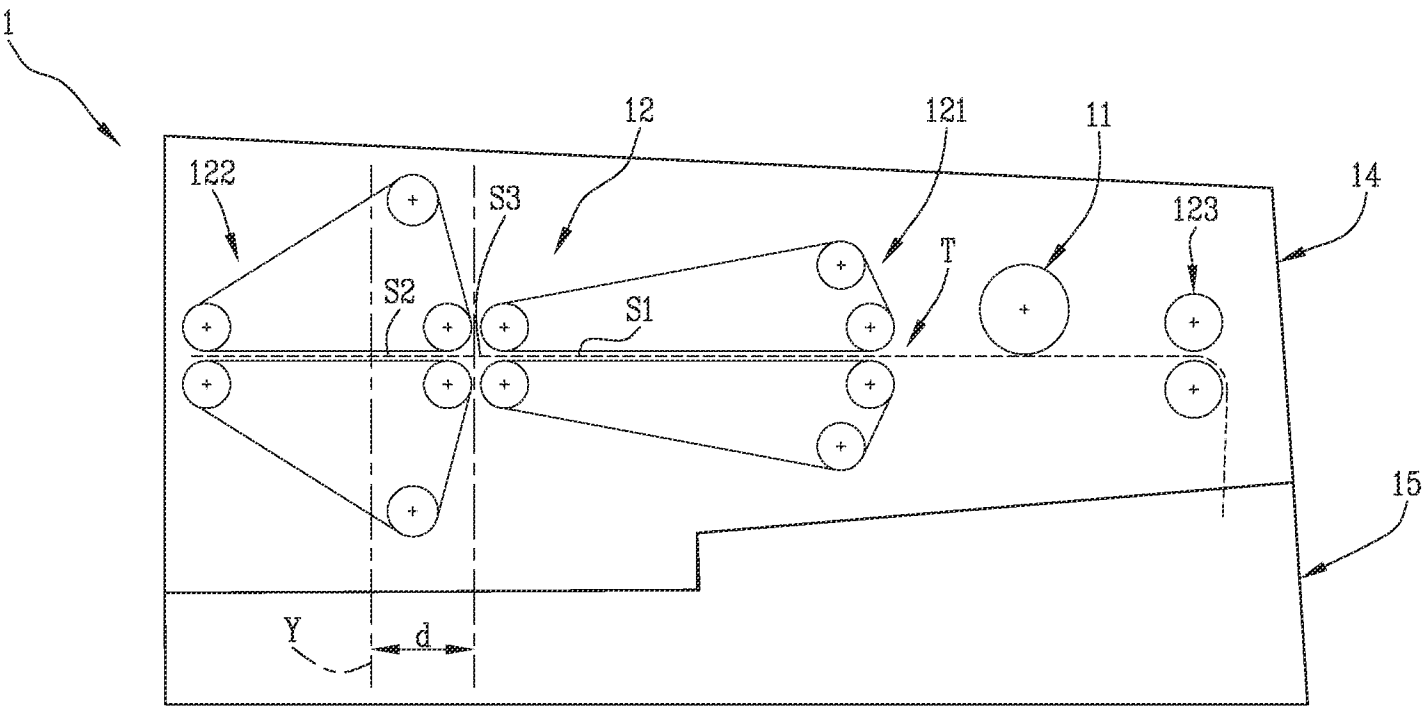
FIG. 3 is a schematic side view of a part of the apparatus of FIG. 1 in a first operating configuration.
Figure 4:
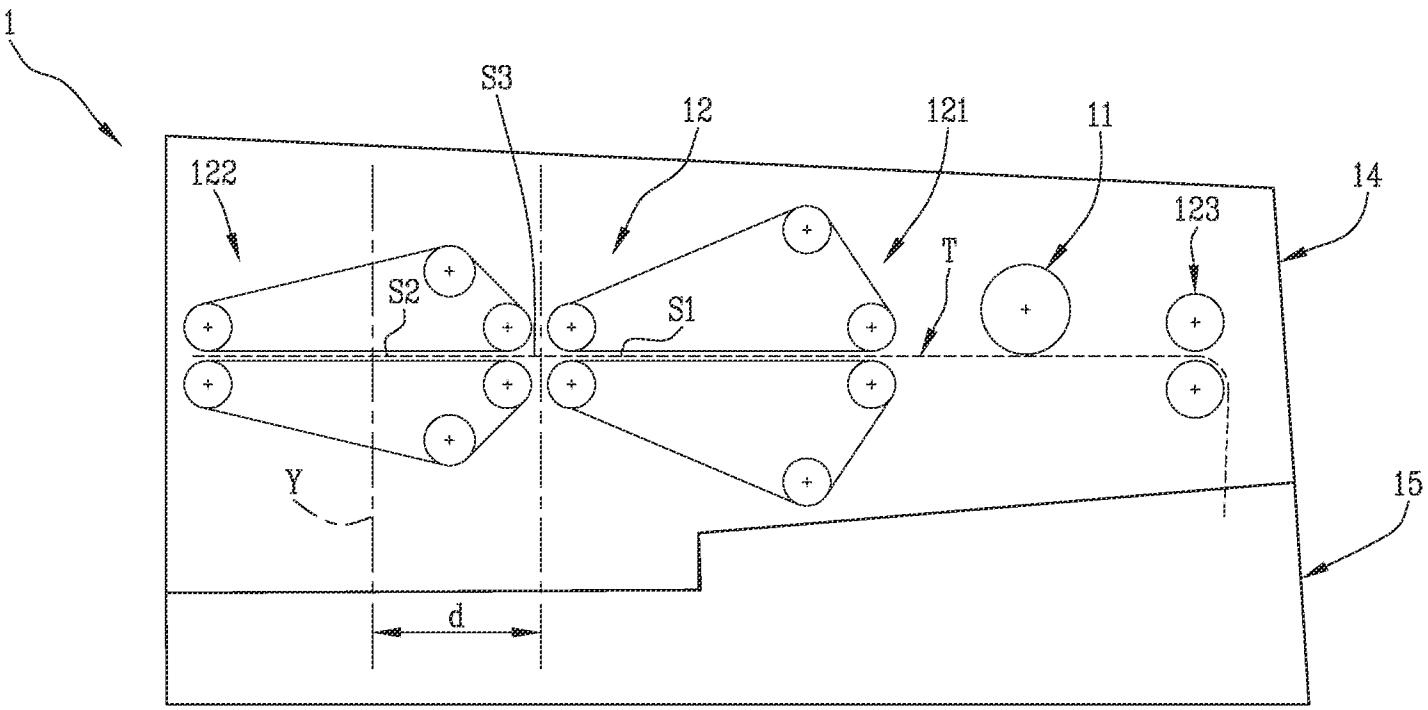
FIG. 4 is a schematic side view of the part of FIG. 3 in a second operating configuration.

FIGS. 1 to 4, and more specifically FIGS. 3 and 4, show a first variant of the apparatus 1. An apparatus according to this first variant can in turn be according to the above-mentioned first alternative or according to the above-mentioned second alternative.

According to the first variant, the apparatus 1 is configured to perform said preliminary adjustment step by varying the geometrical configuration of the respective tensioning units 1212 and 1222 of said drawing units 121 and 122. In this case, the preliminary adjustment step is performed by means of an adjustment movement such that said intermediate sector S3 moves both relative to said Y axis and relative to said weakening system 11.

According to the first variant, the adjustment system 114 is configured to act between said structure 14 and the tensioning units 1212 and 1222, in such a way that said adjustment movement is a movement of the tensioning units 1212 and 1222 relative to said structure 14. See FIG. 2.

In FIG. 3 the first variant of the apparatus adopts a first example operating configuration, and in a FIG. 4 it adopts a second example operating configuration. The value of the distance d between the axis Y and the third intermediate sector S3 is smaller in the first operating configuration with respect to the second operating configuration.

The first operating configuration can be considered as functional to perform the packaging method for packaging articles having a first shorter dimension D, or more simply "small" articles.

The second operating configuration can be considered as functional to perform the packaging method for packaging articles having a first longer dimension D, or more simply "long" articles. In that sense, the greater distance d in FIG. 4 with respect to FIG. 3 is a way of allowing a stopping space sufficient to stop the piece Q after the separation. The smaller distance d in FIG. 3 with respect to FIG. 4 is used to reduce the above-mentioned negative effects of the separation step without losing productivity, since the length of the additional stretch which the piece Q must follow after the separation step, as it decreases with the decrease of the distance d, is also less.

Figure 5:
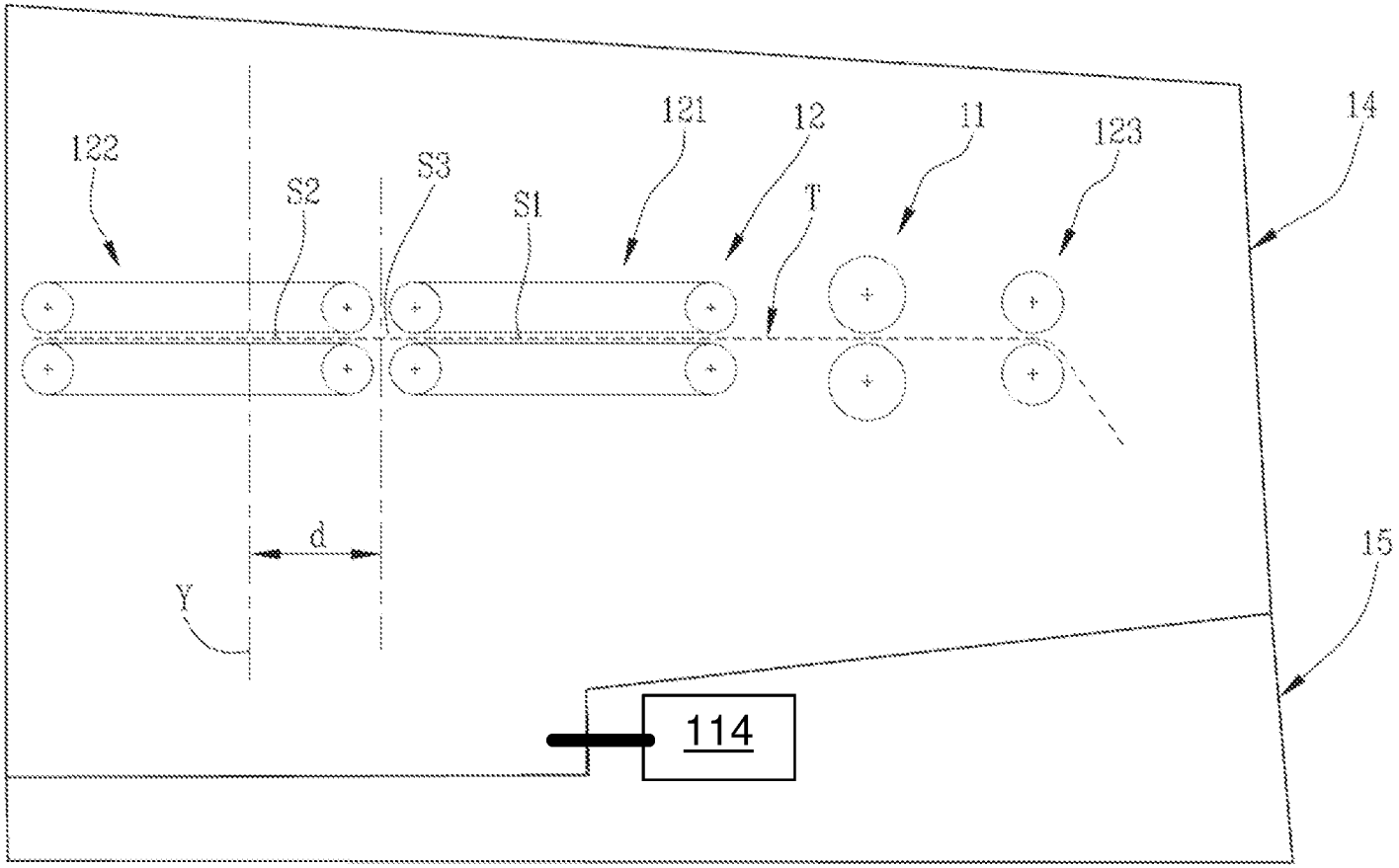
FIG. 5 is a schematic side view of a part of a second variant of a possible example of a possible example of an apparatus according to the invention, in a first operating configuration corresponding to the first operating configuration of the first variant of FIG. 3.
Figure 6:
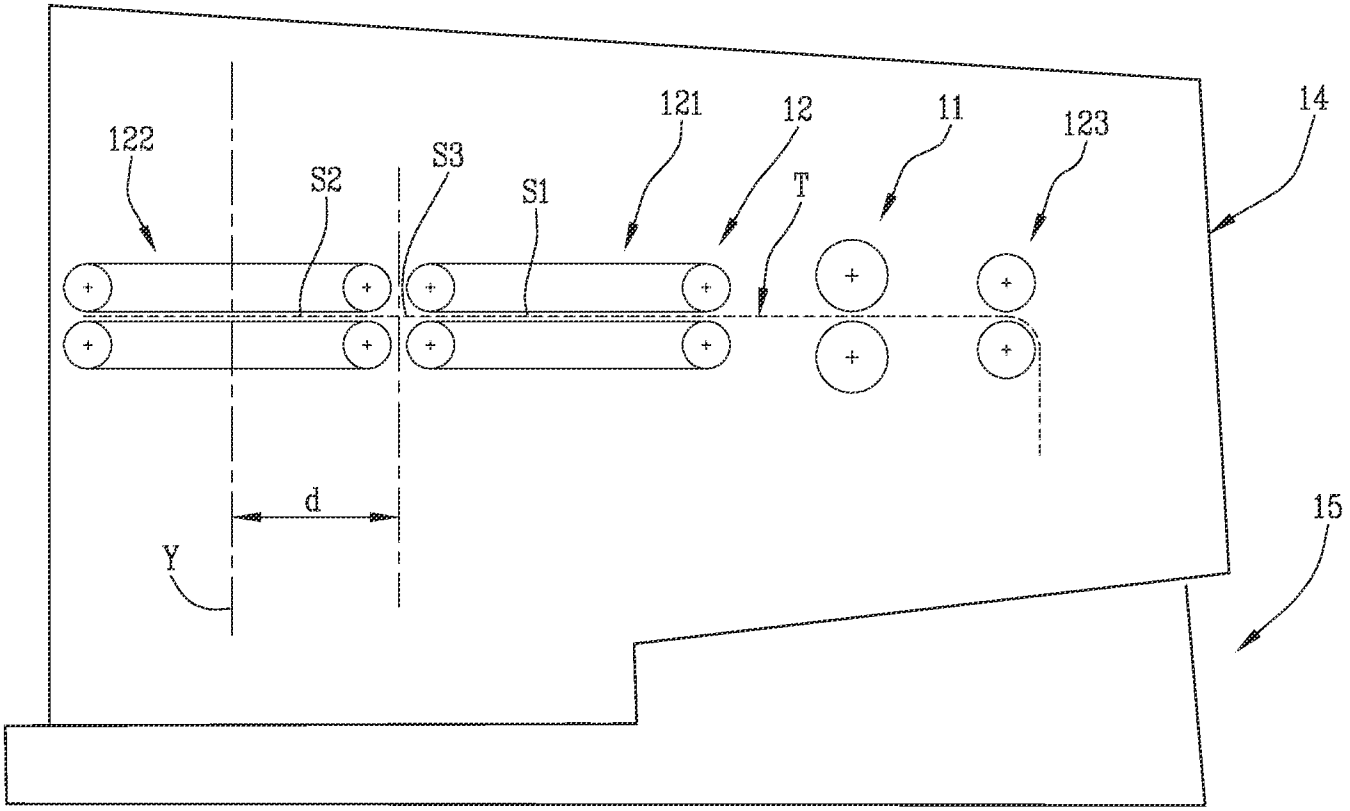
FIG. 6 is a schematic side view of the part of the second variant embodiment of FIG. 5, in a second operating configuration corresponding to the second operating configuration of the first variant of FIG. 4.

FIGS. 5 and 6 show a second variant of the apparatus 1. An apparatus according to this second variant can in turn be according to the above-mentioned first alternative or according to the above-mentioned second alternative.

According to the second variant, the apparatus 1 is configured to perform said preliminary adjustment step by means of an adjustment movement such that both the drawing system 12 and the weakening system 11 move solidly connected to each other relative to the axis Y.

According to this second variant, the adjustment system 114 is configured for acting on said structure 14 in such a way that said adjustment movement corresponds to a movement of said structure 14 relative to the frame 15. See FIG. 5.

The third intermediate sector S3 can be considered as an interface point between the first drawing unit 121 and the second drawing unit 122. For this reason, the distance d can be considered as a distance along the operating path T between the axis Y and the interface point between the drawing units 121 and 122.

The invention claimed is:

1. An apparatus for automatically packaging at least one article made of a plastic film, comprising:

a weakening system for automatically performing a step of weakening a part of said film, to obtain a weakness on said part;

a drawing system for automatically performing a step of drawing at least said part along an operating path and, during said drawing step, a step of separating said part from the remaining part of the film, such that said part, once separated, corresponds to a piece of the film;

a wrapping system for automatically performing a step of wrapping said article in said piece;

wherein said drawing system, in order to perform said drawing step, is configured to apply on said film at least a first drawing force along a first sector of said operating path and a second drawing force along a second sector of said operating path, said first sector and second sector defining between them a third intermediate sector which is interposed between said first sector and second sector, said first, second, and third intermediate sectors being positioned, along said operating path, downstream of said weakening system;

wherein said drawing system is configured to perform said separating step, differentiating said first and second drawing forces from each other upon positioning of said weakness in said third intermediate sector;

wherein said wrapping system is configured to perform said wrapping step by moving said article along an axis transversal to said operating path, such that said article intercepts transversely the piece along said axis;

wherein the apparatus is configured to perform a preliminary step of adjusting a distance along the operating path between said third intermediate sector and said axis, to allow adjustment of the distance as a function of an input value correlated with an extension of the piece along the operating path, said extension of the piece being correlated to at least a first dimension of the article.

2. The apparatus according to claim 1, wherein:

said input value is correlated with said first dimension of the piece to increase with the increase in said first dimension of the piece;

said apparatus is configured to allow said user to perform a step of preliminary setting of said input value;

said apparatus is configured to perform the adjusting step automatically as a function of said input value, by mathematical function according to which said distance reduces with the reduction of said input value.

3. The apparatus according to claim 1, wherein:

said weakening system is configured to repeat, for each article of a plurality of articles, said weakening step, to obtain a plurality of weaknesses on said film with a weakness spacing along the operating path, said weakness spacing being such as to obtain the first dimension of the piece corresponding to the set input value;

the drawing system is configured to repeat sequentially, for each article of said plurality of articles, said drawing and separating steps;

the wrapping system is configured to repeat sequentially, for each article of said plurality of articles, said wrapping step.

4. The apparatus according to claim 2, wherein:

said drawing system comprises, for applying said first drawing force, a first drawing unit operatively positioned along said first sector, and, for applying said second drawing force, a second drawing unit operatively positioned along said second sector, said first drawing unit and second drawing unit being positioned, along said operating path, downstream of said weakening system;

said drawing system is configured so that each of said first and second drawing units apply the respective first and second drawing forces by a respective drawing movement tangential to the film, so that the respective force of the first and second drawing forces is proportional to a respective speed of the respective drawing movement;

said drawing system is configured for differentiating from each other said first and second drawing forces by differentiating from each other the respective speeds of the respective drawing movements, so that the drawing movement of one of the first and second drawing units closest to the wrapping system is faster than the drawing movement of the other of the first and second drawing units closest to the weakening system.

5. The apparatus according to claim 4, wherein:

each of said first and second drawing units comprises a respective pair of belts and a respective tensioning unit for tensioning and moving the belts of the respective pair along respective tensioning paths, such that a variation of a geometrical configuration of the respective tensioning unit corresponds to a variation of the respective tensioning paths of the belts of the respective pair, the belts of said respective pair being situated on mutually opposite sides of said operating path.

6. The apparatus according to claim 5, wherein the apparatus is configured to perform said preliminary step of adjusting by varying the geometrical configuration of the respective tensioning units of said first and second drawing units, such that said preliminary step of adjusting is performed by adjustment movement such that said third intermediate sector moves both relative to said axis and relative to said weakening system.

7. The apparatus according to claim 5, wherein said apparatus is configured to perform said preliminary step of adjusting by an adjustment movement such that both the drawing system and the weakening system move in an integral fashion with each other relative to said axis, said drawing system comprising a third drawing unit situated, along said operating path, upstream of said weakening system.

8. The apparatus according to claim 7, comprising a structure which supports said weakening system and drawing system and an adjustment system for causing said adjustment movement.

9. The apparatus according to claim 8, wherein said adjustment system acts between said structure and the respective tensioning units, such that said adjustment movement is a movement of the respective tensioning units relative to said structure.

10. The apparatus according to claim 8, wherein said adjustment system acts on said structure such that said adjustment movement corresponds to a movement of said structure relative to a frame of the apparatus.

11. A method for automatically packaging articles made of a plastic film, comprising, for at least one article, an operating sequence comprising:

a weakening step of weakening a part of said film, to obtain a weakness on said part;

a drawing step of drawing at least said part along an operating path;

during said drawing step, a separating step of separating said part from a remaining part of the film, such that said part, once separated, corresponds to a piece of the film, said separating step being performed after said weakening step;

a wrapping step of wrapping said article in said piece;

wherein said drawing step is performed by applying on said film at least a first drawing force along a first sector of said operating path and a second drawing force along a second sector of said operating path, said first sector and second sector defining an intermediate sector between said first sector and second sector;

wherein said separating step is performed by differentiating said first and second drawing forces from each other upon positioning of said weakness in said intermediate sector;

wherein said wrapping step is performed by moving said article along an axis transversal to said operating path, such that said article intercepts transversely the piece along said axis; and a preliminary step of adjusting a distance along the operating path between said intermediate sector and said axis, such that said distance is adjusted as a function of an input value correlated with an extension of the piece along the operating path, said extension of the piece being correlated to at least a first dimension of the article.

12. The method according to claim 11, wherein:

said input value is correlated with said first dimension of the piece to increase with an increase in said first dimension of the piece;

the method comprises a preliminary setting up step during which said input value is set;

the adjusting step is performed automatically as a function of said input value, by a mathematical function according to which said distance reduces with a reduction of said input value.

13. The packaging method according to claim 12, comprising repeating the operating sequence for each article of a plurality of articles, wherein the respective weakening steps are performed to obtain a plurality of weaknesses on said film with a weakness spacing along the operating path, said weakness spacing being such as to obtain the first dimension of the piece corresponding to the set input value.

* * * * *